US009227432B2

(12) United States Patent
Watanabe et al.

(10) Patent No.: US 9,227,432 B2
(45) Date of Patent: Jan. 5, 2016

(54) CONVEYOR DEVICE AND INKJET RECORDING DEVICE INCLUDING CONVEYOR DEVICE

(71) Applicant: KYOCERA Document Solutions Inc., Osaka (JP)

(72) Inventors: Takeshi Watanabe, Osaka (JP); Hidenori Takenaka, Osaka (JP); Tomohisa Soda, Osaka (JP); Jumpei Hobo, Osaka (JP); Masami Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/635,436

(22) Filed: Mar. 2, 2015

(65) Prior Publication Data

US 2015/0246557 A1 Sep. 3, 2015

(30) Foreign Application Priority Data

Mar. 3, 2014 (JP) ..... 2014-040434
Mar. 5, 2014 (JP) ..... 2014-042254
Mar. 5, 2014 (JP) ..... 2014-042255

(51) Int. Cl.

| | |
|---|---|
| ***B41J 11/00*** | (2006.01) |
| ***B65H 5/02*** | (2006.01) |
| ***B65H 5/22*** | (2006.01) |
| ***B65H 9/04*** | (2006.01) |

(52) U.S. Cl.

CPC ..... *B41J 11/007* (2013.01); *B65H 5/021* (2013.01); *B65H 5/224* (2013.01); *B65H 9/04* (2013.01)

(58) Field of Classification Search

USPC ..... 347/95–99, 100–107, 171, 187, 213, 347/215, 217, 218

See application file for complete search history.

(56) References Cited

U.S. PATENT DOCUMENTS

| | | | | |
|---|---|---|---|---|
| 7,887,179 | B2 * | 2/2011 | Toyoshima | B41J 11/0025 347/101 |
| 8,025,390 | B2 * | 9/2011 | Phillips | B41J 11/007 347/104 |
| 8,382,276 | B2 * | 2/2013 | Ikeda | B41J 2/155 347/104 |

FOREIGN PATENT DOCUMENTS

| | | |
|---|---|---|
| JP | 2011-183746 A | 9/2011 |
| JP | 2012-153048 A | 8/2012 |

* cited by examiner

*Primary Examiner* — Kristal Feggins
(74) *Attorney, Agent, or Firm* — Studebaker & Brackett PC

(57) ABSTRACT

A conveyor device is arranged to face a recording head. The conveyor device includes a conveyance belt and a suction section. The conveyance belt conveys a recording medium. The suction section includes a guide member that supports the recording medium through the conveyance belt. The suction section sucks the recording medium through a plurality of first holes passing through the guide member and a plurality of second holes passing through the conveyance belt to attach the recording medium to the conveyance belt. None of the first holes are formed in a first region of the guide member. The first region is a region where a partial region pertaining to a feeding member overlaps with a head facing region facing the recording head.

18 Claims, 13 Drawing Sheets

CONVEYOR DEVICE AND INKJET RECORDING DEVICE INCLUDING CONVEYOR DEVICE

INCORPORATION BY REFERENCE

The present application claims priority under 35 U.S.C. §119 to Japanese Patent Application Nos. 2014-04225 and 2014-042254 each fled Mar. 5, 2014, and No. 2014-040434, filed Mar. 3, 2014. The contents of this application are incorporated herein by reference in their entirety.

BACKGROUND

The present disclosure relates to conveyor devices and inkjet recording devices including a conveyor device.

Inkjet recording devices have been known as one type of recording devices. The inkjet recording devices include an image forming section to form an image on paper as a recording medium. The image forming section of such an inkjet recording device includes an inkjet head including nozzles to eject ink droplets and a conveyor device to convey paper. The inkjet recording device forms an image on the paper in a manner that the inkjet head ejects ink droplets to the paper conveyed by the conveyor device.

The conveyor device included in the image forming section includes, for example, a conveyance belt and a suction section, thereby conveying the paper while sucking the paper to the conveyance belt. The conveyance belt is driven to rotate for conveying the paper loaded thereon. The suction section includes a guide member that supports the paper through the conveyance belt. The suction section sucks the paper through a plurality of holes passing through both the guide member and the conveyance belt to attach the paper to the conveyance belt.

In an example, an inkjet recording device has been proposed in which no hole for suction is formed in a region of the guide member immediately below the inkjet head. This configuration may reduce an air flow (hereinafter referred to as a "suction draft") generated when the suction section sucks air immediately below the inkjet head.

SUMMARY

A conveyor device according to an aspect of the present disclosure is arranged to face a recording head. The conveyor device includes a conveyance belt and a suction section. The conveyance belt conveys a recording medium. The suction section includes a guide member that supports the recording medium through the conveyance belt. The suction section sucks the recording medium through a plurality of first holes passing through the guide member and a plurality of second holes passing through the conveyance belt to attach the recording medium to the conveyance belt. None of the first holes are located in a first region of the guide member. The first region is a region where a partial region of the guide member pertaining to a feeding member overlaps with a head facing region of the guide member facing the recording head. The feeding member is provided on a path through which the recording medium is conveyed to the conveyor device, and feeds the recording medium from an upstream side to a downstream side of the path.

An inkjet recording device according to another aspect of the present disclosure includes a conveyor device and a recording head. The recording head includes an inkjet head that ejects ink droplets. The conveyor device is arranged to face the recording head. The conveyor device includes a conveyance belt and a suction section. The conveyance belt conveys a recording medium. The suction section includes a guide member that supports the recording medium through the conveyance belt. The suction section sucks the recording medium through a plurality of first holes passing through the guide member and a plurality of second holes passing through the conveyance belt to attach the recording medium to the conveyance belt. None of the first holes are located in a first region of the guide member. The first region is a region where a partial region of the guide member pertaining to a feeding member overlaps with a head facing region of the guide member facing the recording head. The feeding member is provided on a path through which the recording medium is conveyed to the conveyor device, and feeds the recording medium from an upstream side to a downstream side of the path.

DETAILED DESCRIPTION

Embodiments of the present disclosure will be described below with reference to the accompanying drawings. Note that the embodiments described below are not intended to limit the scope of the appended claims. Not all the elements described in the following embodiments are necessarily essential to solution to problems in the present disclosure. The same reference numbers are assigned to the same elements throughout the drawings.

Figure 1:
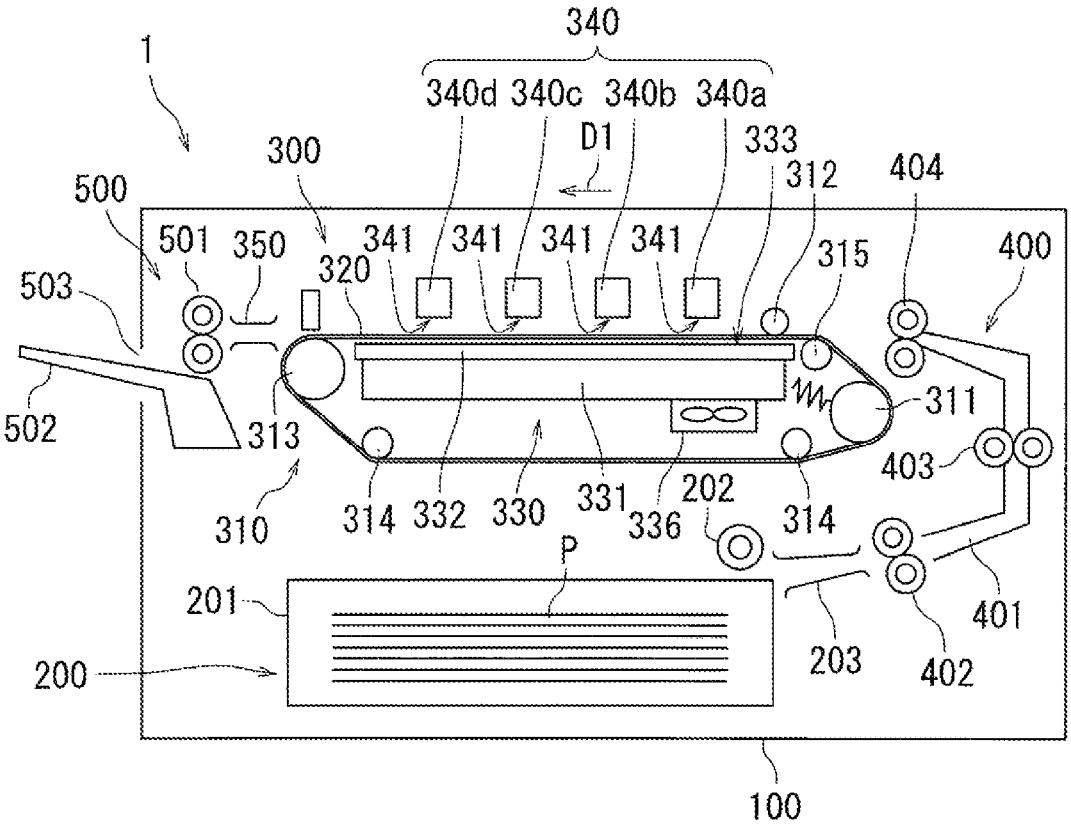
FIG. 1 is a diagram illustrating a configuration example of an inkjet recording device including a conveyor device according to an embodiment.

FIG. 1 is a diagram illustrating a configuration example of an inkjet recording device 1 including a conveyor device 310 according to an embodiment.

The inkjet recording device 1 includes a device casing 100, a paper feed section 200, an image forming section 300, a paper conveyance section 400, and a paper ejecting section 500. The paper feed section 200 in the present embodiment is disposed in the lower part of the device casing 100. The image forming section 300 is disposed above the paper feed section 200. The paper conveyance section 400 is disposed on one side of the image forming section 300. The paper ejecting section 500 is disposed on the other side of the image forming section 300.

The paper feed section 200 includes a paper feed cassette 201 detachable from the device casing 100, a paper feed roller 202, and guide plates 203. The paper feed roller 202 is disposed above one end side of the paper feed cassette 201. The guide plates 203 are disposed between the paper feed roller 202 and the paper conveyance section 400.

Plural sheets of paper P (one example of recording media) are accommodated inside the paper feed cassette 201 in a stacked state. The paper feed roller 202 takes out the paper P accommodated in the paper feed cassette 201 on a sheet by sheet basis. The guide plates 203 guide the paper P taken out by the paper feed roller 202 to the paper conveyance section 400.

The paper conveyance section 400 includes a paper conveyance pathway 401, a first conveyance roller pair 402, a second conveyance roller pair 403, and a registration roller pair 404. The paper conveyance pathway 401 constitutes a part of a paper conveyance path. The first conveyance roller pair 402 is provided at an inlet of the paper conveyance pathway 401. The second conveyance roller pair 403 is provided in the middle of the paper conveyance pathway 401. The registration roller pair 404 is provided at an outlet of the paper conveyance pathway 401.

The first conveyance roller pair 402 pinches the paper P conveyed from the paper feed section 200 and sends out it to the paper conveyance pathway 401. The second conveyance roller pair 403 pinches the paper P sent out by the first conveyance roller pair 402 and conveys it downstream in the paper conveyance pathway 401. The registration roller pair 404 performs skew correction on the paper P conveyed by the second conveyance roller pair 403. The registration roller pair 404 once keeps the paper P for synchronization between image formation and conveyance of the paper P. The registration roller pair 404 then sends out the paper P to the image forming section 300 with timing of image formation.

The image forming section 300 forms an image on the paper P. The image forming section 300 employs an inkjet recording method for image formation. The image forming section 300 includes a conveyor device 310, plural types of inkjet heads (examples of recording heads) 340, and a conveyance guide 350. The plural types of inkjet heads 340 in the present embodiment are disposed above the conveyor device 310 side by side from the upstream side to the downstream side of the paper conveyance path. The conveyor device 310 is arranged to face the plural types of inkjet heads 340. Specifically, respective nozzle surfaces 341 of the plural types of inkjet heads 340 face a support surface 333 of the conveyor device 310 with a conveyance belt 320 interposed. The conveyance guide 350 is disposed downstream of the conveyor device 310 in the paper conveyance path. Note that arrangements of the inkjet heads 340 and the conveyor device 310 are not limited to those illustrated in FIG. 1. That is, only required is to make the nozzle surfaces 341 of the inkjet heads 340 to face the support surface 333 of the conveyor device 310 with the conveyance belt 320 interposed. For example, the inkjet heads 340 may be disposed aside the conveyor device 310.

The image forming section 300 in the present embodiment includes four types of inkjet heads 340, that is, inkjet heads 340*a* for black (Bk) color, inkjet heads 340*b* for cyan (C) color, inkjet heads 340*c* for magenta (M) color, and inkjet heads 340*d* for yellow (Y) color. The four types of inkjet heads 340*a*, 340*b*, 340*c*, and 340*d* each include a plurality of nozzles to eject ink droplets. The surfaces of the inkjet heads 340 where the nozzles are arranged serve as the nozzle surfaces 341. The nozzles of the inkjet heads 340*a* for black color eject black ink droplets. The nozzles of the inkjet heads 340*b* for cyan color eject cyan ink droplets. The nozzles of the inkjet heads 340*c* for magenta color eject magenta ink droplets. The nozzles of the inkjet heads 340*d* for yellow color eject yellow ink droplets. The nozzles of the inkjet heads 340 eject ink droplets to the paper P conveyed to the point facing the nozzle surfaces 341, thereby forming an image of a character, a figure, etc. Note that although only one inkjet head is illustrated for each of the four types of inkjet heads 340*a*, 340*b*, 340*c*, and 340*d* in FIG. 1 for the sake of better illustration, the image forming section 300 in the present embodiment includes a plurality of inkjet heads 340 of each type.

A suction roller 312 guides and then loads the paper P conveyed by the paper conveyance section 400 onto the conveyance belt 320. Favorably, the paper P is loaded on the conveyance belt 320 so that its center in the width direction accords with the center in the width direction of the conveyance belt 320. The width direction of the paper P herein is orthogonal to a paper conveyance direction D1 on the recording surface of the paper P. The width direction of the conveyance belt 320 is orthogonal to the paper conveyance direction D1 on the surface of the conveyance belt 320 on which the paper P is to be loaded. The paper P loaded on the conveyance belt 320 is sucked and attached to the conveyance belt 320 and conveyed in the paper conveyance direction D1. The conveyance belt 320 conveys the paper P to the point facing the nozzle surfaces 341 of the four types of inkjet heads 340*a*, 340*b*, 340*c*, and 340*d* sequentially. The four types of inkjet heads 340*a*, 340*b*, 340*c*, and 340*d* eject ink droplets onto the paper P conveyed to the point facing the respective nozzle surfaces 341. As a result, an image is formed on the paper P. The conveyance belt 320 conveys the paper P on which the image is formed to the conveyance guide 350. The conveyance guide 350 guides the paper P conveyed by the conveyor device 310 to the paper ejecting section 500.

The paper ejecting section 500 includes an ejection roller pair 501, an exit tray 502, and an exit port 503. The exit tray 502 is fixed to the device casing 100 to protrude outside the device casing 100 from the exit port 503. The paper P having passed through the conveyance guide 350 is sent to the exit port 503 by the ejection roller pair 501 and ejected onto the exit tray 502.

Figure 2:
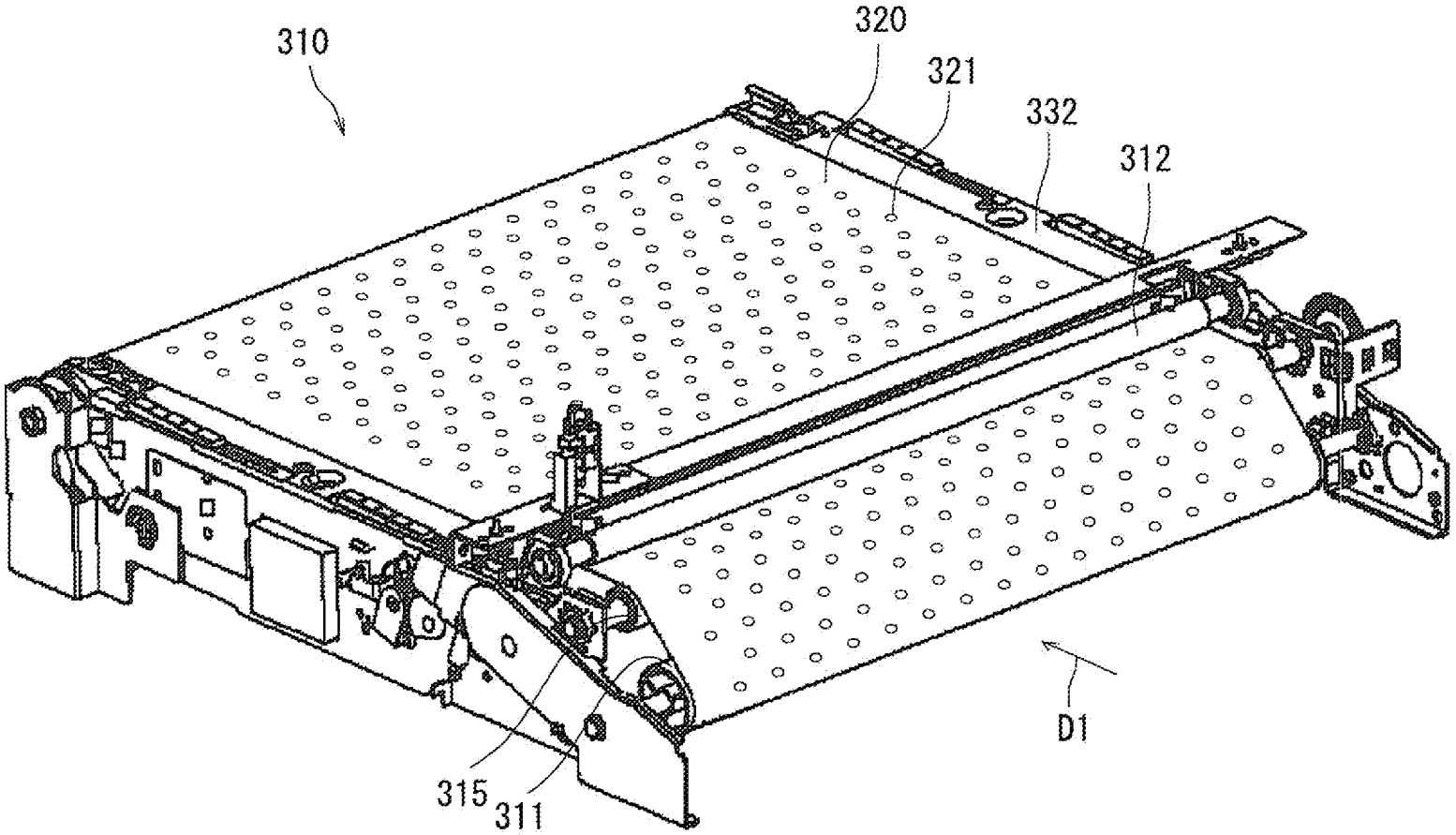
FIG. 2 is a first perspective view of the conveyor device according to the embodiment.
Figure 3:
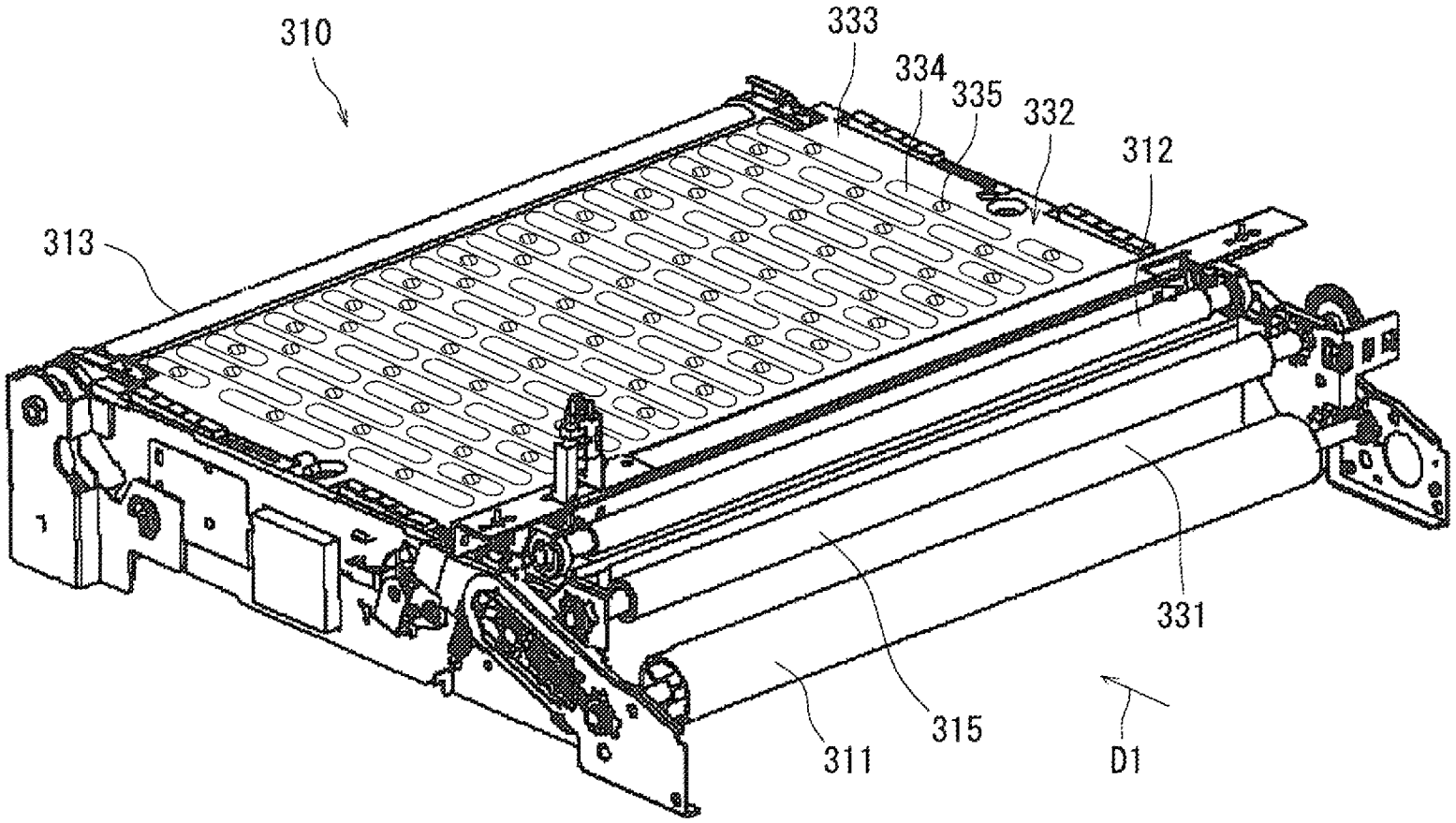
FIG. 3 is a second perspective view of the conveyor device according to the embodiment.

FIG. 2 is a first perspective view of the conveyor device 310 according to the embodiment. FIG. 3 is a second perspective view of the conveyor device 310 according to the embodiment. FIG. 3 illustrates the conveyor device 310 from which the conveyance belt 320 is taken away. The conveyor device 310 will be described with reference to FIGS. 1-3.

The conveyor device 310 conveys the paper P conveyed by the paper conveyance section 400 and loaded on the conveyance belt 320 to the point that faces the inkjet heads 340 and then conveys it to the paper ejecting section 500. The conveyor device 310 according to the present embodiment conveys the paper P in a manner to suck and attach the paper P to the conveyance belt 320. The conveyor device 310 includes a tension roller 311, a suction roller 312, a drive roller 313, a plurality (two in the present embodiment) guide rollers 314, a speed detecting roller 315, the endless conveyance belt 320, and a suction section 330.

The conveyance belt 320 is wound around the tension roller 311, the drive roller 313, the guide rollers 314, and the speed detecting roller 315 that are spaced at predetermined intervals. The tension roller 311 and the speed detecting roller 315 in the present embodiment are disposed near the paper conveyance section 400, while the drive roller 313 is disposed near the paper ejecting section 500. The drive roller 313 is driven to rotate for rotating the conveyance belt 320 in the direction in which the loaded paper P is conveyed in the paper conveyance direction D1. The paper conveyance direction D1 herein is a direction in which the paper P is conveyed in the image forming section 300 and a direction toward the paper ejecting section 500 from the paper conveyance section 400. The suction roller 312 is disposed upstream in the paper conveyance direction D1.

As illustrated in FIG. 2, a plurality of holes 321 are formed in the surface of the conveyance belt 320, that is, the surface portion on which the paper P is to be loaded. Hereinafter, the holes 321 (second holes) formed in the conveyance belt 320 are referred to as suction holes. The suction holes 321 pass through the conveyance belt 320 in the thickness direction thereof. Note that the number and arrangement of the suction holes 321 illustrated in FIG. 2 are mere examples, and any number and arrangement different from those in FIG. 2 may be possible.

The suction section 330 is disposed on the reverse side of the conveyance belt 320. The suction section 330 sucks the paper P through the suction holes 321 in the conveyance belt 320 to attach the paper P to the surface of the conveyance belt 320. The suction section 330 includes an air flow chamber 331, a guide member 332, and a sucking device 336.

The air flow chamber 331 is a box member of which top is opened, for example. The opening at the top of the air flow chamber 331 is covered with the guide member 332. The guide member 332 has the support surface 333 that supports the paper P through the conveyance belt 320. The guide member 332 in the present embodiment is a plate member having a surface serving as the support surface 333. As illustrated in FIG. 3, a plurality of grooves 334 and a plurality of holes 335 are formed in the support surface 333. Hereinafter, the holes 335 (first holes) formed in the support surface 333 are referred to as "through holes". The through holes 335 in the present embodiment are formed in the bottoms of the grooves 334 to pass through the guide member 332 in the thickness direction thereof from the bottoms of the grooves 334 to the reverse surface of the guide member 332. Note that the numbers and arrangements of the grooves 334 and the through holes 335 illustrated in FIG. 3 are mere examples, and any numbers and arrangements different from those in FIG. 3 may be possible. The arrangements of the grooves 334 and the through holes 335 will be described later in detail with reference to FIGS. 4 and 7-13.

The sucking device 336 is a fan, for example. The sucking device 336 is disposed under the air flow chamber 331, for example. An exhaust port is formed at a location in the bottom wall of the air flow chamber 331 where the sucking device 336 is disposed. When the sucking device 336 is driven, the air in the air flow chamber 331 passes through the exhaust port and the sucking device 336 and is then discharged outside the air flow chamber 331. This generates negative pressure in the air flow chamber 331. The negative pressure sucks the paper P through the suction holes 321 in the conveyance belt 320 and the through holes 335 in the support surface 333 to attach the paper P to the conveyance belt 320. In this manner, the conveyor device 310 can convey the paper P, while attaching the paper P to the conveyance belt 320. Note that the sucking device 336 is not limited to the fan and may be another device capable of generating negative pressure, for example, a vacuum pump.

Figure 4:
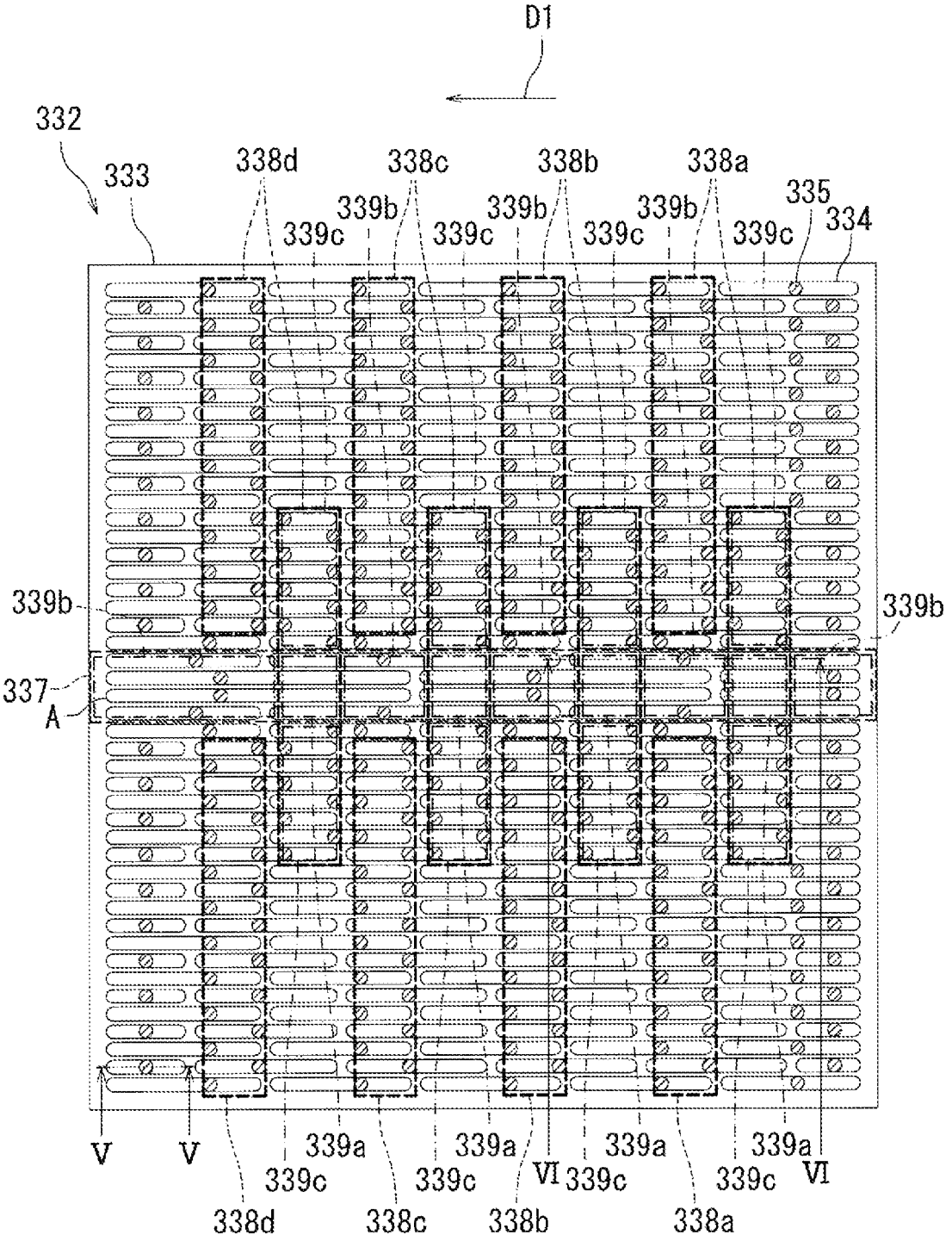
FIG. 4 is a plan view of a guide member according to the embodiment.
Figure 5:
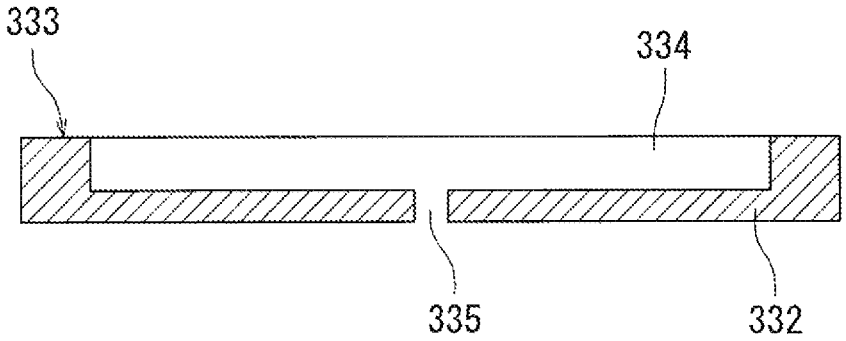
FIG. 5 is a cross sectional view taken along the line V-V in FIG. 4.
Figure 6:
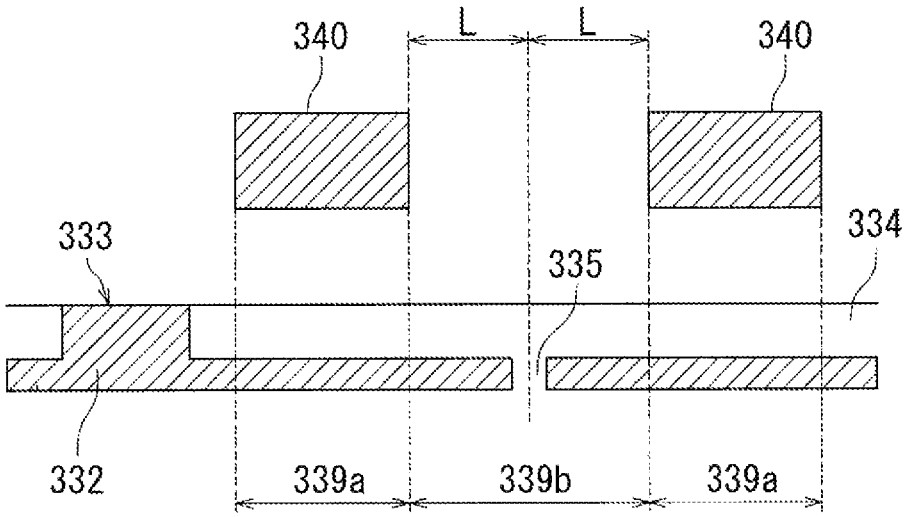
FIG. 6 is a cross sectional view taken along the line VI-VI in FIG. 4.

FIG. 4 is a plan view of the guide member 332 according to the embodiment. FIG. 5 is a cross sectional view taken along the line V-V in FIG. 4. FIG. 6 is a cross sectional view taken along the line VI-VI in FIG. 4. With reference to FIGS. 4-6, a description will be made next about the configurations of the support surface 333 and the grooves 334 and the through holes 335 formed in the support surface 333.

Rectangular regions 338 (338*a*, 338*b*, 338*c*, and 338*d*, hereinafter referred to as head facing regions) in the support surface 333 are regions in the support surface 333 that face the nozzle surfaces 341 of the inkjet heads 340. Note that the conveyance belt 320 intervenes between the inkjet heads 340 and the support surface 333. More precisely, the head facing regions 338 are regions in the support surface 333 that face the nozzle surfaces 341 of the inkjet heads 340 through the conveyance belt 320. The head facing regions 338*a* face the nozzle surfaces 341 of the inkjet heads 340*a* for black color. The head facing regions 338*b* face the nozzle surfaces 341 of the inkjet heads 340*b* for cyan color. The head facing regions 338*c* face the nozzle surfaces 341 of the inkjet heads 340*c* for magenta color. The head facing regions 338*d* face the nozzle surfaces 341 of the inkjet heads 340*d* for yellow color.

The inkjet recording device 1 according to the present embodiment is of line head type. Accordingly, the image forming section 300 includes four types of plural (three in the present embodiment) inkjet heads 340*a*, 340*b*, 340*c*, and 340*d*. The inkjet heads 340 of each type are arranged as follows. The three inkjet heads 340*a* for black color are arranged in a staggered manner in the width direction of the support surface 333. The width direction of the support surface 333 herein is orthogonal to the paper conveyance direction D1 in the support surface 333. Similarly, the three inkjet heads 340*b* for cyan color are arranged in a staggered manner in the width direction of the support surface 333. The three inkjet heads 340*c* for magenta color are arranged in a staggered manner in the width direction of the support surface 333. The three inkjet heads 340*b* for yellow color are arranged in a staggered manner in the width direction of the support surface 333.

A rectangular region 337 in the support surface 333 is a region (hereinafter referred to as a "partial region") in the support surface 333 that pertains to a feeding member, which will be described later. Specifically, the partial region 337 is a region in the support surface 333 that corresponds to a belt part region of the conveyance belt 320. The belt part region herein is a region where a part of the paper P (hereinafter referred to as a "contact part") comes in contact with the feeding member in a region of the conveyance belt 320 where the paper P is loaded.

The feeding member is provided upstream of the conveyor device 310 in the paper conveyance path to feed the paper P from the upstream side to the downstream side of the paper conveyance path in a manner to be in contact with a part of the paper P. In feeding the paper P downstream, the feeding member applies a force for feeding the paper P downstream to the contact part of the paper P. By this force, the feeding member is in friction with the contact part of the paper P, thereby producing the paper dust. For this reason, the paper dust tends to be produced at and attached to the contact part of the paper P especially. This may result in that much paper dust is conveyed in the belt part region on which the contact part is loaded and the partial region 337 corresponding to the belt part region. Note that the feeding member sends the paper P by applying the force to a part (the contact part) of the paper P and therefore tends to produce the paper dust more than a member that feeds the paper P in manners to be in contact with the entire surface of the paper P, for example, the registration roller pair 404.

The feeding member in the present embodiment is a combination of the paper feed roller 202, the first conveyance roller pair 402, and the second conveyance roller pair 403. Where the feeding member includes a plurality of members, the partial region 337 may be a region pertaining to all or some of the members of the feeding member. The partial region 337 in the present embodiment is a region pertaining to the paper feed roller 202. That is, the partial region 337 in the present embodiment is a region in the support surface 333 that corresponds to a region of the conveyance belt 320 where a part of the paper P that comes in contact with the paper feed roller 202 is loaded. This is because the following reason. In picking out the paper P from the paper feed cassette 201, the paper feed roller 202 applies rather strong frictional force to the paper P. Further, when the paper feed roller 202 applies the frictional force to the paper P, the paper P may be in friction with another piece of paper P in the paper feed cassette 201. These may be the causes of an increase in amount of produced paper dust. Therefore, the amount of the produced paper dust increases at a part where the paper feed roller 202 is in friction with the paper P.

Hereinafter, a region in the support surface 333 that does not face the nozzle surfaces 341 of the inkjet heads 340, that is, a region therein other than the head facing regions 338 is referred to as a "head non-facing region". Regions 339*a* where the partial region 337 overlaps with the head facing regions 338 are referred to as "first regions". While, regions 339*b* in the partial region 337 that do not overlap with the head facing regions 338 are referred to as "second regions". Further, regions 339*c* in the head facing regions 338 that do not overlap with the partial region 337 are referred to as "third regions". Yet further, a region in the head non-facing region that does not overlap with the partial region 337 is referred to as a "fourth region".

As illustrated in FIG. 4, the plural grooves 334 are formed all over the support surface 333. The grooves 334 each are in an oval shape extending the paper conveyance direction D1 when viewed in plan, for example. The length of the grooves 334 in the longitudinal direction, that is, the paper conveyance direction D1 may differ among the grooves 334. The length of the grooves 334 in the short direction, that is, the width direction of the support surface 333 is substantially equal among the grooves 334, for example. For example, the grooves 334 are formed to face at least two suction holes 321 in the conveyance belt 320. As the conveyance belt 320 advances, suction holes 321 facing a groove 334 change one by one.

As illustrated in FIGS. 4 and 5, one or more through holes 335 are formed in the bottom of each groove 334. In FIG. 4, the through holes 335 are indicated as hatched circles. The through holes 335 are circular in shape when viewed in plan. The through holes 335 pass through the guide member 332 in the thickness direction thereof from the bottom surfaces of the grooves 334 to the reverse surface of the guide member 332. Note that although at least one through hole 335 is formed in each groove 334 in the example illustrated in FIG. 4, a through hole 335 may not be necessarily formed in every groove 334. In other words, a groove 334 in which none of the through holes 335 are formed may be formed in the support surface 333.

As illustrated in FIG. 4, none of the through holes 335 are located in the first regions 339*a* in the present embodiment. This configuration can reduce the suction draft generated above the first regions 339*a* in the head facing region 338 where especially much paper dust may be present. Accordingly, blowing up of the paper dust can be suppressed above the first regions 339*a* where especially much paper dust is present, thereby enabling prevention of adhesion of the paper dust to the nozzles. In consequence, occurrence of nozzle clogging caused by adhesion of the paper dust can be reduced effectively.

By contrast, the through holes 335 are located in the third regions 339*c* in the example illustrated in FIG. 4. With this configuration, the suction draft stronger than that generated above the first regions 339*a* can be generated above the third regions 339*c* in the head facing regions 338 where not so much paper dust may be present. Deficiency of a suction force applied to the paper P can accordingly be overcome in the third regions 339*c*, thereby enabling prevention of lift off of the paper P. Further, in the configuration example illustrated in FIG. 4, each first region 339*a* is located between two third regions 339*c* and is smaller than the third regions 339*c*. In turn, the prevention of lift off of the paper P in the third regions 339*c* can result in prevention of lift off of the paper P in the first regions 339*a*. Thus, occurrence of an image artifact can be reduced that may be caused due to change in distance between the inkjet heads 340 and the paper P. Further, occurrence of a paper jam can be reduced immediately below the inkjet heads 340. Note that the paper dust may be less attached to the nozzles above the third regions 339*c* where not so much paper dust is present, and therefore, the suction draft may need to be reduced not so significantly.

Moreover, in the configuration example illustrated in FIG. 4, the through holes 335 in the third regions 339*c* are formed at locations around the outer edges of the third regions 339*c*, specifically, locations that meet the outer edges. This configuration can reduce the suction draft generated above the third regions 339*c*, especially, above the inside of the third regions 339*c* more than that in the case where the through holes 335 are located in the central parts of the third regions 339*c*. Accordingly, adhesion of the paper dust to the nozzles above the third regions 339*c* can be prevented in addition to lift off of the paper.

Still further, in the configuration example illustrated in FIG. 4, the through holes 335 in the second regions 339*b* are located apart from the first regions 339*a* as far as possible. Specifically, as illustrated in FIG. 6, the through holes 335 in the second regions 339*b* are formed at locations where distances L to two first regions 339*a* between which a second region 339*b* is interposed are equal. The suction draft generated above the first regions 339*a* may increase by air suction through the through holes 335 in the second regions 339*b*. However, the above configuration can prevent such an increase. Further, the second regions 339*b* as well as the first regions 339*a* are regions where especially much paper dust is present. For this reason, air suction through the through holes 335 tends to blow up the paper dust in the second regions 339*b*. In view of this, employment of the above configuration can prevent as far as possible the paper dust blown up by air suction through the through holes 335 in the second regions 339*b* from moving to the first regions 339*a* and adhering to the nozzles above the first regions 339*a*. Note that though not illustrated in FIG. 6, practically, the conveyance belt 320 intervenes between the inkjet heads 340 and the guide member 332.

The partial region 337 may be conductive in the present embodiment. In other words, the part of the guide member 332 that constitutes the partial region 337 may be formed from a conductive member. This configuration can prevent charging caused by friction between the support surface 333 and the conveyance belt 320 in the partial region 337. If the paper dust is charged, the charged paper dust may repel the charged support surface 333 to be blown up and adhere to the nozzles. However, the above configuration can prevent such blowing up and adhesion in the partial region 337 where especially much paper dust is present. Note that the partial region 337 may be conductive in the configuration examples described later and illustrated in FIGS. 7-13.

Figure 7:
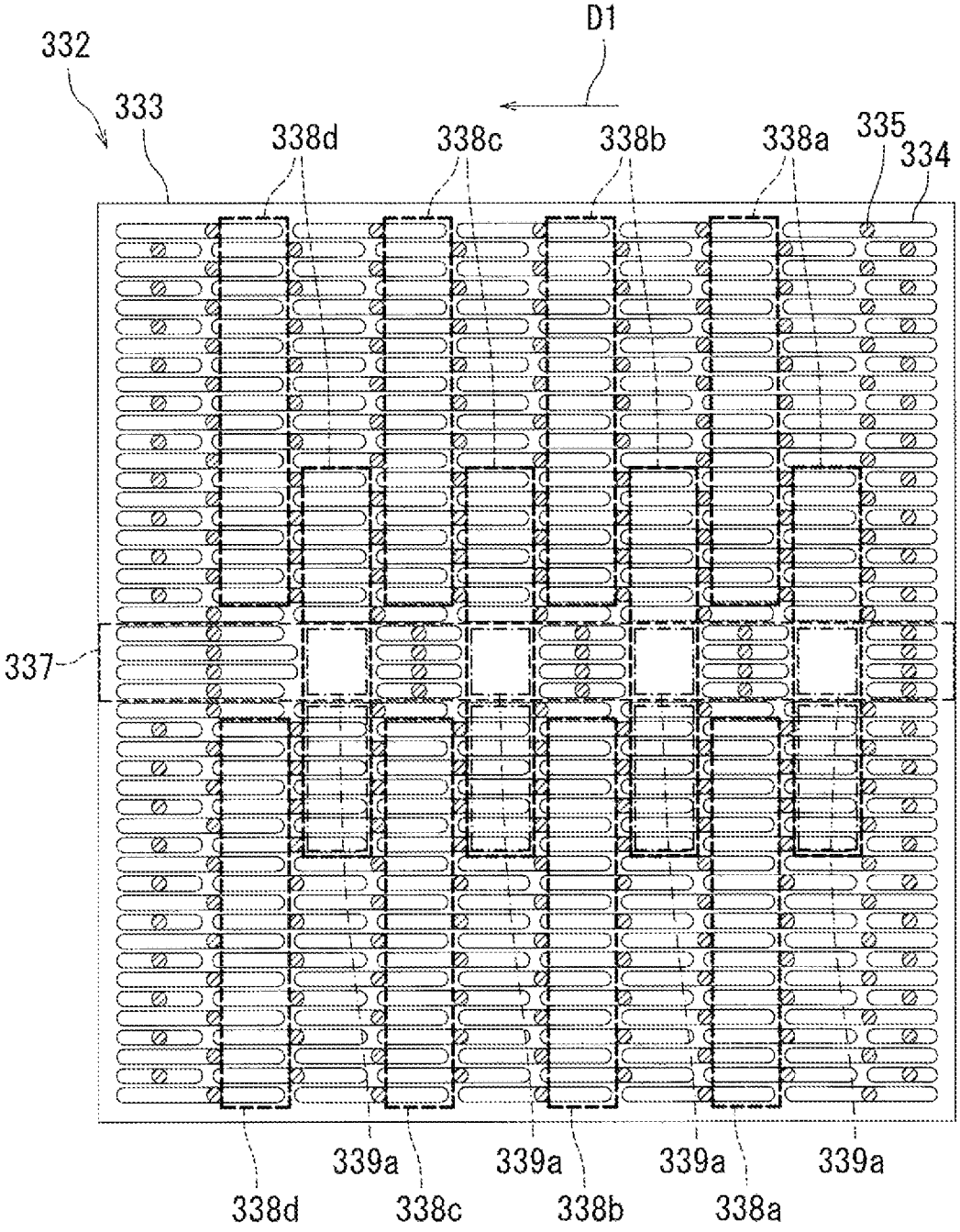
FIG. 7 is a plan view of a guide member according to the first variation of the embodiment.

FIG. 7 is a plan view of a guide member 332 according to the first variation of the embodiment.

As illustrated in FIG. 7, neither the grooves 334 nor the through holes 335 are formed in the first regions 339*a* in the first variation. This configuration can further reduce the suction draft generated above the first regions 339*a* more than the case where grooves A (see FIG. 4) are formed in the first regions. Here, the grooves A are the grooves 334 each extending from a first region 339*a* to a second region 339*b* and each having a bottom in the second region 339*b* through which a through hole 335 passes. As a result, the paper dust can be prevented from being blown up and adhering to the nozzles above the first regions 339*a* further effectively.

Figure 8:
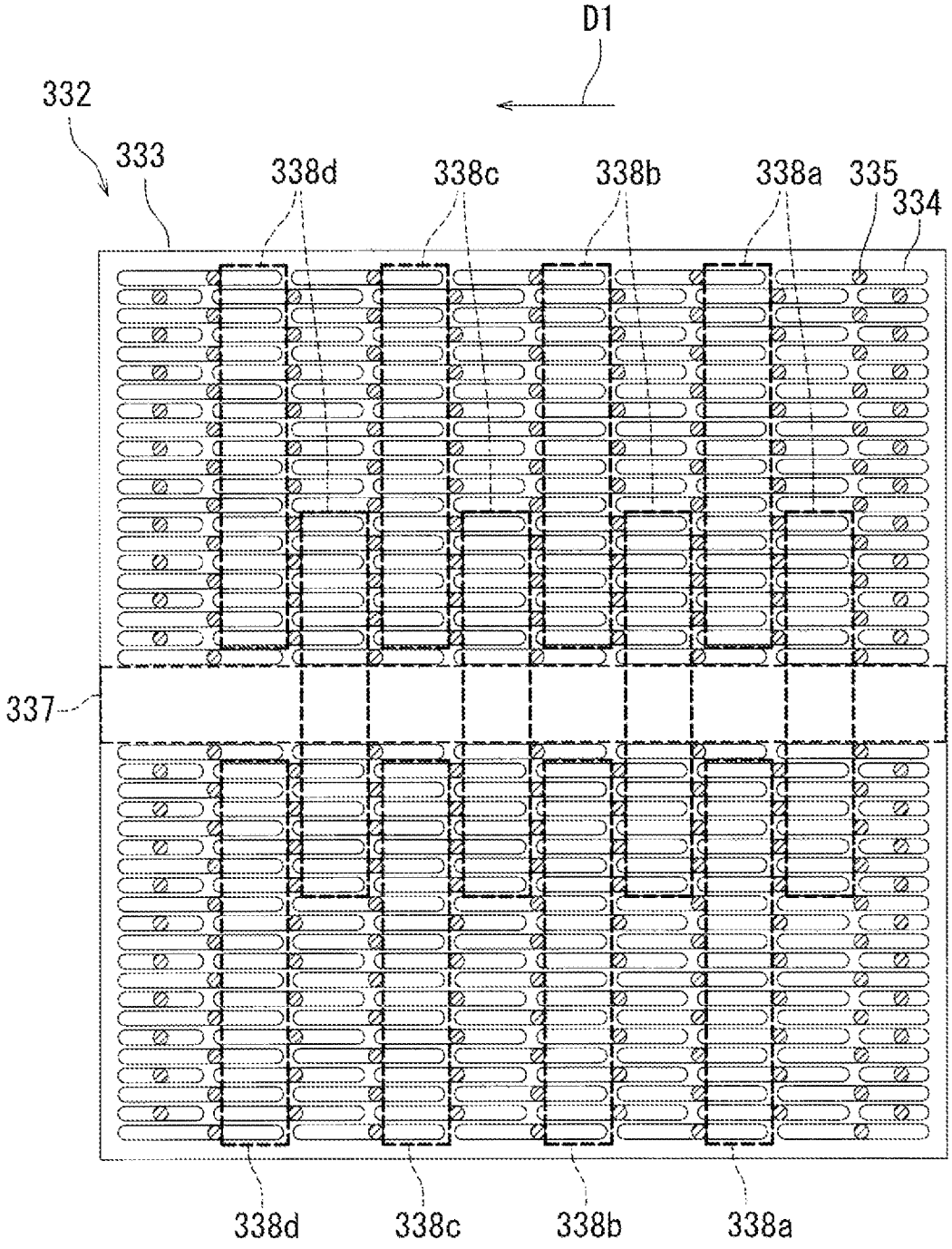
FIG. 8 is a plan view of a guide member according to the second variation of the embodiment.

FIG. 8 is a plan view of a guide member 332 according to the second variation of the embodiment.

As illustrated in FIG. 8, neither the grooves 334 nor the through holes 335 are formed in the partial region 337 in the second variation. This configuration can reduce the suction draft generated above the entire partial region 337 where especially much paper dust is conveyed. Blowing up of the paper dust above the entire partial region 337 can accordingly be suppressed. As a result, adhesion of the paper dust to the nozzles can be prevented further effectively.

Figure 9:
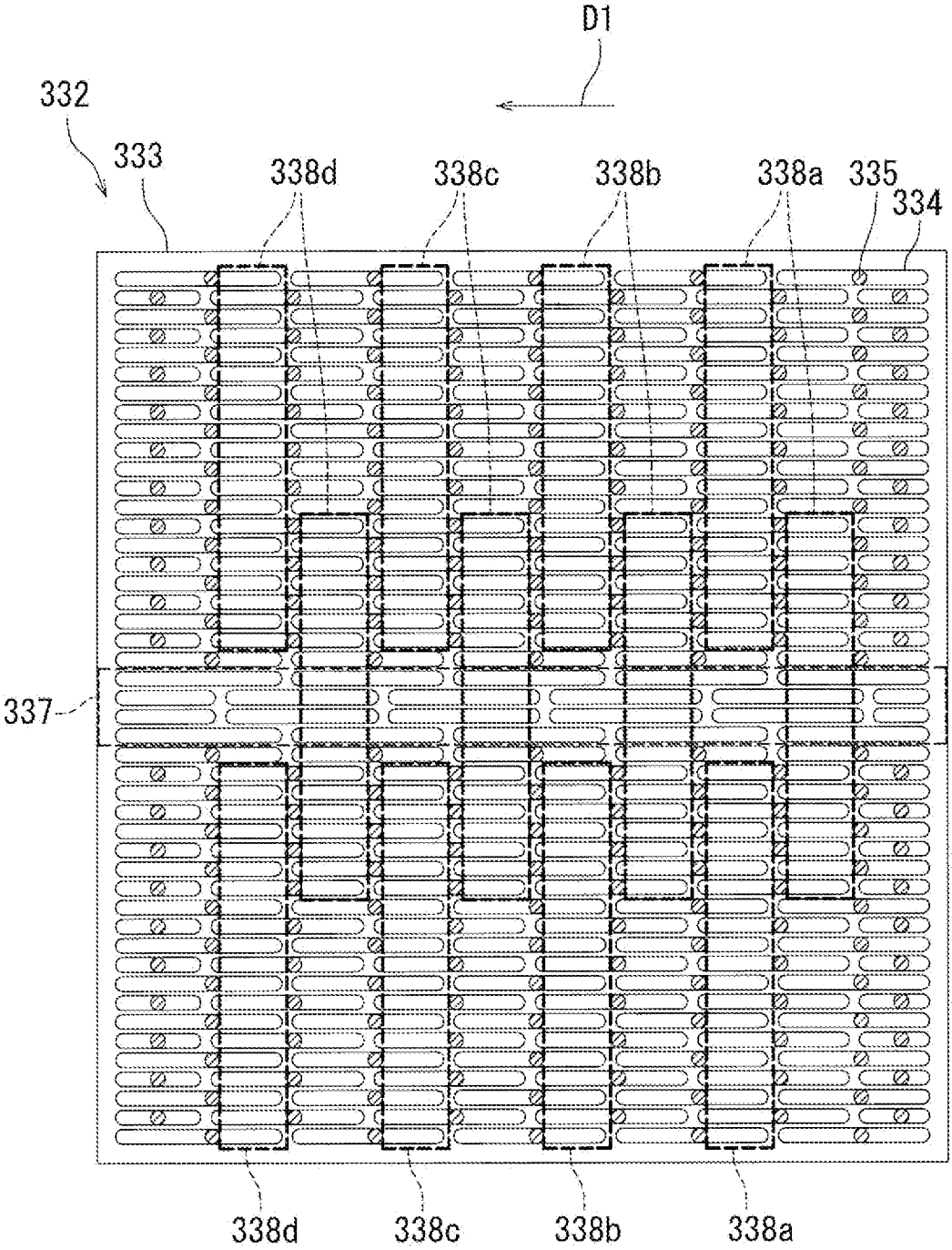
FIG. 9 is a plan view of a guide member according to the third variation of the embodiment.

FIG. 9 is a plan view of a guide member 332 according to the third variation of the embodiment.

As illustrated in FIG. 9, grooves 334 in which none of the through holes 335 are located lie in the partial region 337 in the third variation. This configuration can reduce the suction draft generated above the entire partial region 337 where especially much paper dust is conveyed more than in the second variation, that is, in the case where neither the grooves 334 nor the through holes 335 are formed. Blowing up of the paper dust above the entire partial region 337 can accordingly be suppressed. As a result, adhesion of the paper dust to the nozzles can be further effectively prevented. In addition, the contact area between the conveyance belt 320 and the guide member 332 can be reduced to reduce friction resistance between the conveyance belt 320 and the guide member 332. This can reduce a burden on the drive motor that drives the conveyance belt 320.

Figure 10:
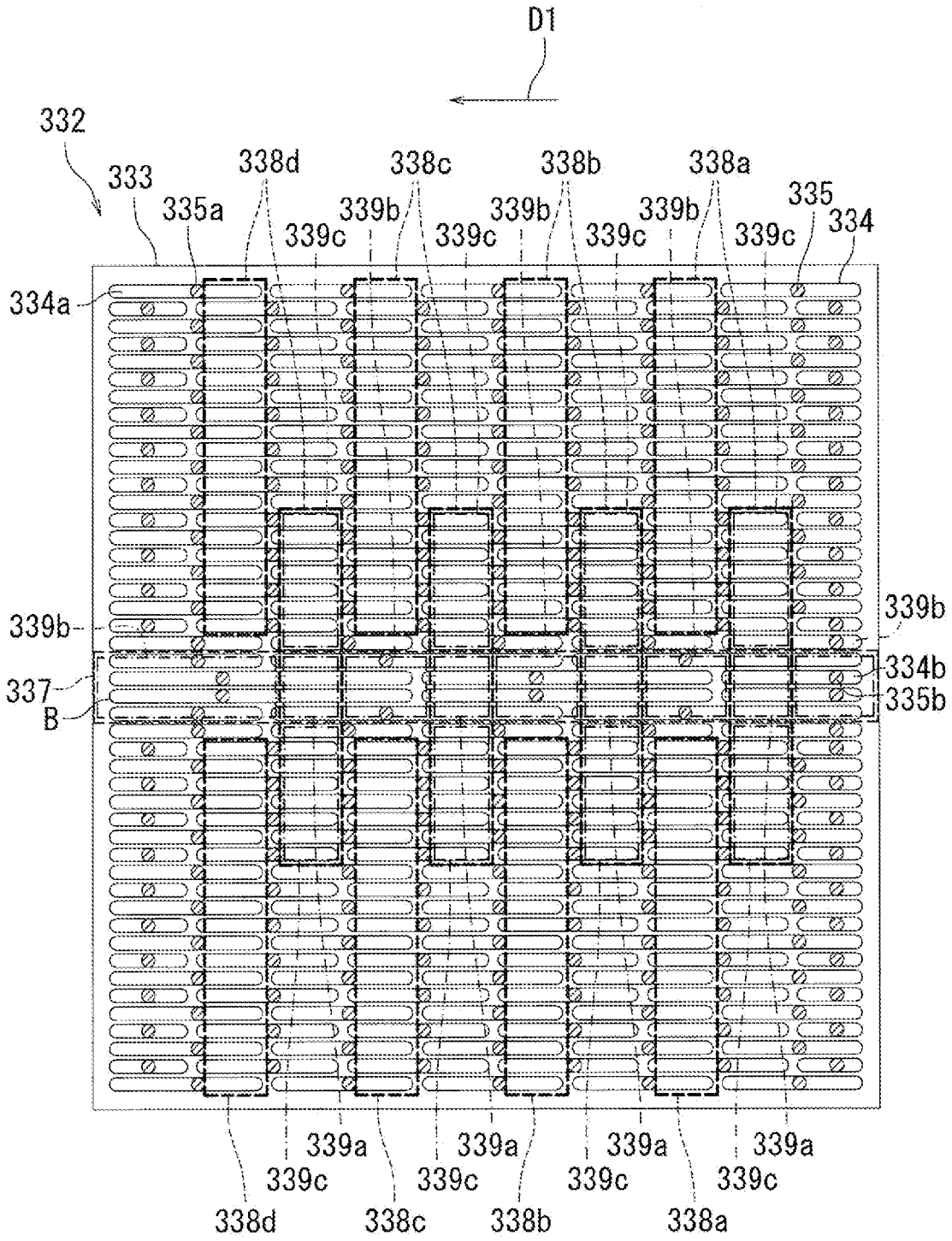
FIG. 10 is a plan view of a guide member according to the fourth variation of the embodiment.

FIG. 10 is a plan view of a guide member 332 according to the fourth variation of the embodiment.

As illustrated in FIG. 10, the through holes 335 are not located in the head facing regions 338 and are located in the head non-facing region in the fourth variation. This configuration can reduce the suction draft generated above the head facing regions 338. Blowing up of the paper dust can be accordingly suppressed above the head facing regions 338, thereby preventing adhesion of the paper dust to the nozzles. Thus, occurrence of nozzle clogging caused by adhesion of the paper dust can be reduced.

By contrast, at least one through hole 335 of the plurality of through holes 335 is located in the head non-facing region closely to a head facing region 338. Hereinafter, the through hole 335*a* located in the head non-facing region closely to a head facing region 338 is referred to as a "close-up through hole". This configuration can slightly increase the suction draft generated above the head facing region 338, especially above a part around the close-up through hole 335*a*. As a result, the suction force acting on the paper P can be sufficient at the part around the close-up through hole 335*a*, thereby preventing lift off of the paper P. In addition, when an appropriate number of close-up through holes 335*a* are formed at appropriate intervals, lift off of the paper P can be prevented in the entire range of the head facing regions 338. Thus, occurrence of an image artifact can be reduced that may be caused due to change in distance between the inkjet heads 340 and the paper P. Additionally, a paper jam immediately below the inkjet heads 340 can be prevented. Note that the number and arrangement of the close-up through holes 335*a* may be determined in consideration with prevention of adhesion of blown paper dust to the nozzles and lift off of the paper P.

In particular, the close-up through hole 335*a* is located in a third region 339*c* of the head facing region 338 where not so much paper dust is present. This configuration can effectively prevent adhesion of the paper dust to the nozzles and lift off of the paper P.

Moreover, in the fourth variation, grooves 334 lying in the third regions 339*c* are grooves (hereinafter referred to as "first grooves") 334*a* each extending from a third regions 339*c* to the fourth region. The close-up through hole 335*a* is located in the bottom of each of the first grooves 334*a*. With this configuration, the first grooves 334*a* can guide the suction draft flowing from above the third regions 339*c* to the close-up through holes 335*a*. Thus, an appropriate suction force acting on the paper P can be ensured above the third regions 339*c*, especially above parts around the close-up through holes 335*a*, thereby reliably preventing lift off of the paper P. In addition, the above configuration can allow the close-up through holes 335*a* to suck mostly the air above the first grooves 334*a*. As such, even if the close-up through holes 335*a* are located around both the respective third regions 339*c* and the respective first regions 339*a* where especially much paper dust is present, air suction through the close-up through holes 335*a* may not increase the suction draft generated above the first regions 339*a*.

By contrast, grooves 334 located in the first regions 339*a* are grooves (hereinafter referred to as "second grooves") 334*b* each extending from a first region 339*a* to a second region 339*b*. The through holes (hereinafter referred to as "second through holes") located in the bottoms of the second grooves 334*b* are located in the second regions 339*b* apart from the first regions 339*a*. With this configuration, air suction through the second through holes 335*b* may not increase the suction draft generated above the first regions 339*a* where especially much paper dust is present. Furthermore, especially much paper dust is present in the second regions 339*b* in which the second through holes 335*b* are located. Air suction through the second through holes 335*b* accordingly tends to blow up the paper dust. In view of this, employment of the above configuration can prevent as far as possible the paper dust blown up by air suction through the second through holes 335*b* from moving to the first regions 339*a* and adhering to the nozzles above the first regions 339*a*.

Figure 11:
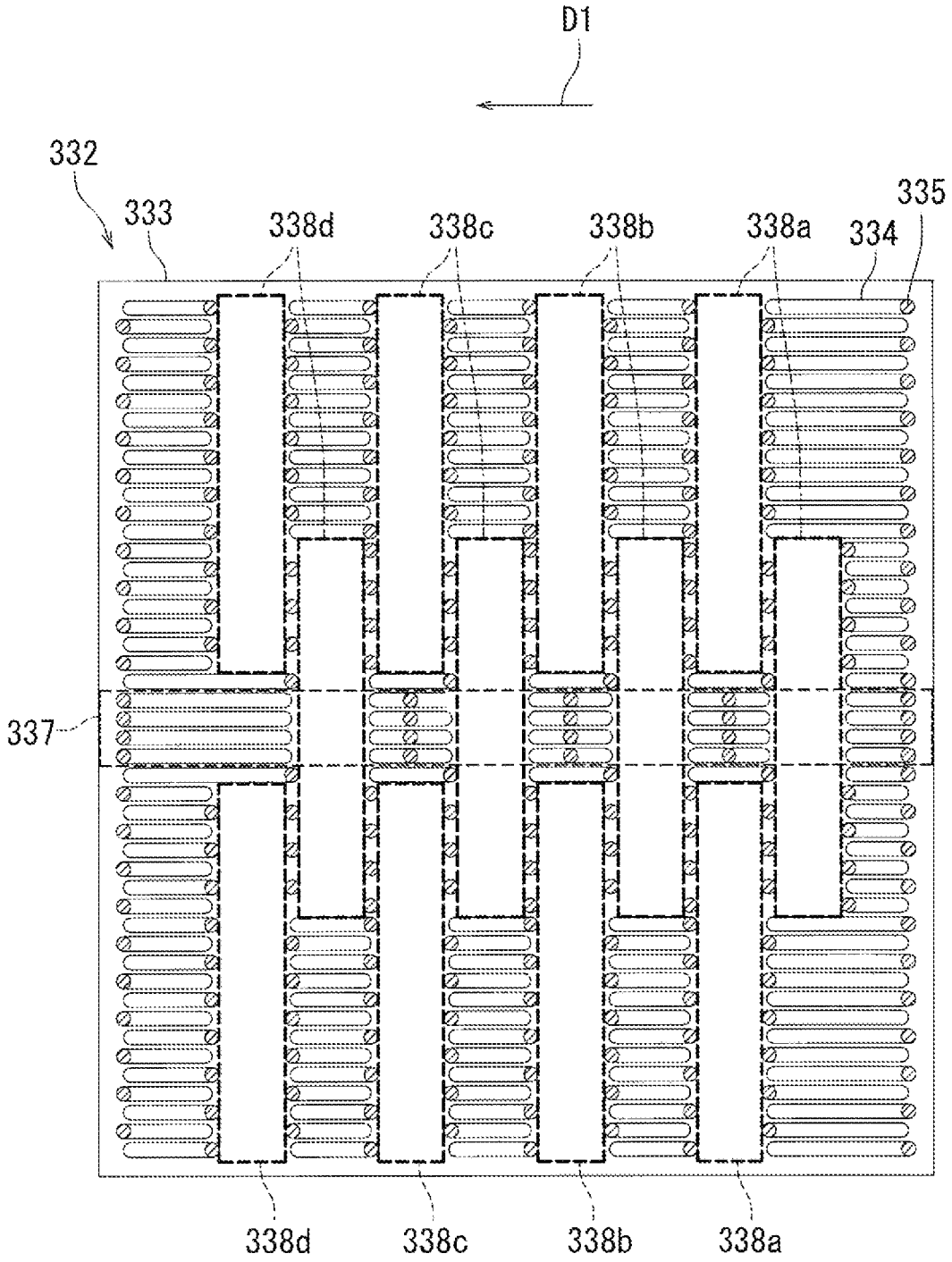
FIG. 11 is a plan view of a guide member according to the fifth variation of the embodiment.

FIG. 11 is a plan view of a guide member 332 according to the fifth variation of the embodiment.

As illustrated in FIG. 11, neither the through holes 335 nor the grooves 334 are formed in the head facing regions 338 in the fifth variation. Specifically, no groove 334 (a groove B, see FIG. 10) extending from a head facing region 338 to the head non-facing region and having a bottom in the head non-facing region through which a through hole 335 passes is located in the head facing regions 338. This configuration can reduce the suction draft generated above the head facing regions 338 further more than the case where such grooves B lie in the head facing regions 338. Thus, blowing up of the paper dust above the head facing regions 338 and adhesion of the paper dust to the nozzles can be further effectively prevented.

Figure 12:
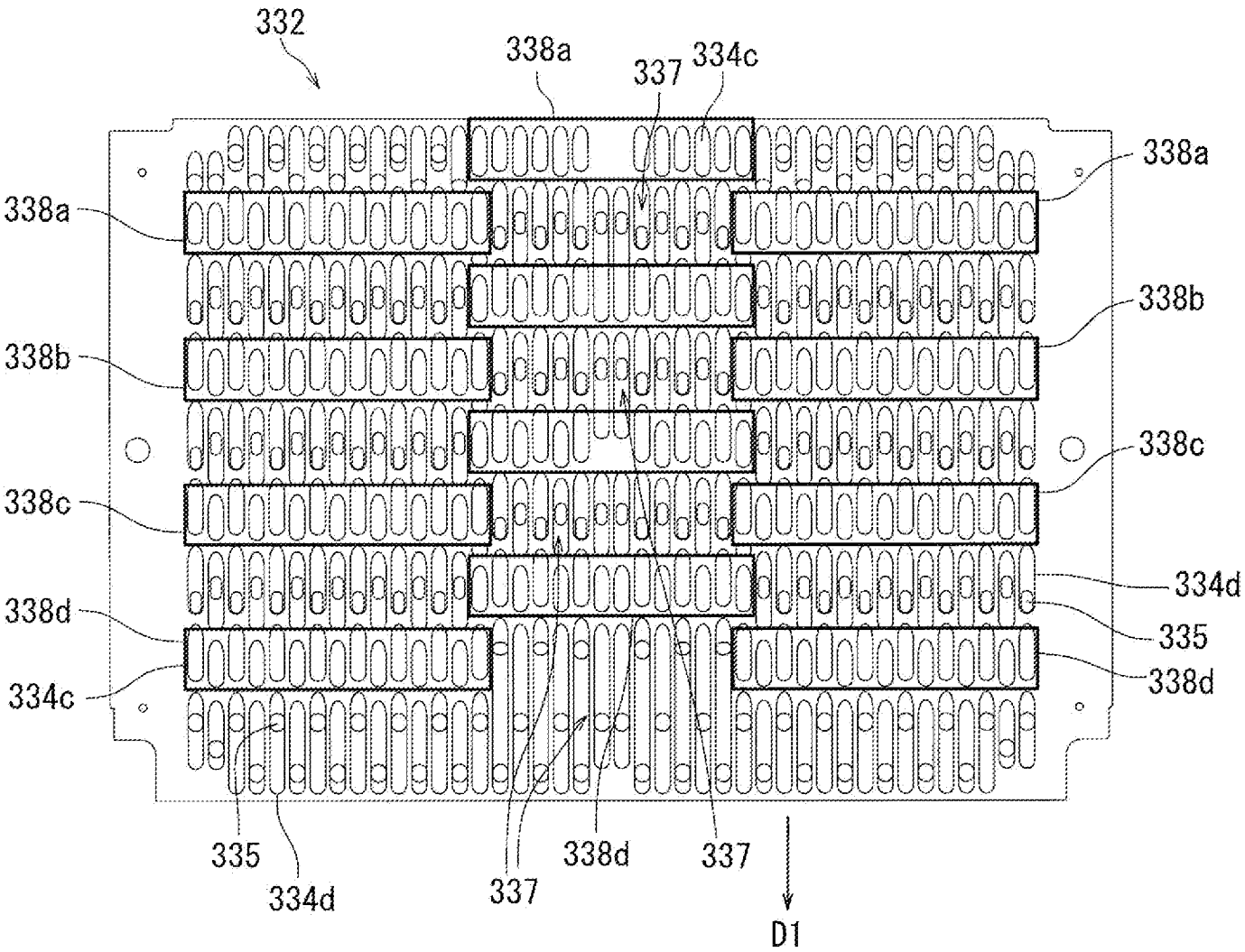
FIG. 12 is a plan view of a guide member according to the sixth variation of the embodiment.

FIG. 12 is a plan view of a guide member 332 according to the six variation of the embodiment.

As illustrated in FIG. 12, at least one third groove 334*c* and a plurality of fourth grooves 334*d* are located in the guide member 332 in the sixth variation. Here, the third groove 334*c* is a groove 334 through which no through hole 335 passes. The fourth grooves 334*d* each are a groove 334 having a bottom through which a through hole 335 passes. The at least one third groove 334*c* is located in each of the head facing regions 338.

This configuration can reduce the suction draft generated above the head facing regions 338. Blowing up of the paper dust can be accordingly suppressed above the head facing regions 338, thereby preventing adhesion of the paper dust to the nozzles. Thus, occurrence of nozzle clogging caused by adhesion of the paper dust can be reduced.

Each of the third groove 334*c* and the fourth grooves 334*d* has an oval shape extending in the conveyance direction D1. The third grooves 334*c* are arranged in the conveyance direction D1 and the direction perpendicular to the conveyance direction D1. The fourth grooves 334*d* are arranged in the conveyance direction D1 and the direction perpendicular to the conveyance direction D1. The third grooves 334*c* can function as ink receivers, thereby reducing ink accumulated between the conveyance belt 320 and the guide member 332. Note that the fourth grooves 334*d* can also function as ink receivers.

Each of the fourth grooves 334*d* has one or more through holes 335. One or two through holes 335 are formed in each of the fourth grooves 334*d* in the configuration example illustrated in FIG. 12. In each of the fourth grooves 334*d* in which one through hole 335 is formed, the through hole 335 is located at one end part, the other end part, or the central part of the fourth groove 334*d*, for example. In each of the fourth grooves 334*d* in which two through holes 335 are formed, the two through holes 335 are located in the opposite end parts of the fourth groove 334*d*, for example. For example, the through holes 335 are arranged in the fourth grooves 334*d* in a staggered manner in the direction orthogonal to the conveyance direction D1.

Each of the surfaces of the third grooves 334*c* is preferably made from a material having absorptivity (hereinafter referred to as a "liquid-absorbing material"). For example, the liquid-absorbing material is disposed on the bottom of each of the third grooves 334*c*. The liquid-absorbing material in the third groove 334*c* can absorb ink resulting from empty ejection or ejection failure, thereby enhancing ink catching efficiency. As a result, ink accumulated in the guide member 332 can be reduced, and stable conveyance of the paper P can be achieved.

The liquid-absorbing material may be an elastic material having absorptivity, for example. The elastic material having absorptivity may be sponge or nonwoven fabric, for example. The sponge may be SOFROUS N (trade name), a polyurethane sponge available from AION Co., Ltd., for example. The nonwoven fabric may be GS felt K10021M (trade name), a polyester/polyurethane nonwoven fabric available from Toray Industries, Inc., for example.

Figure 13:
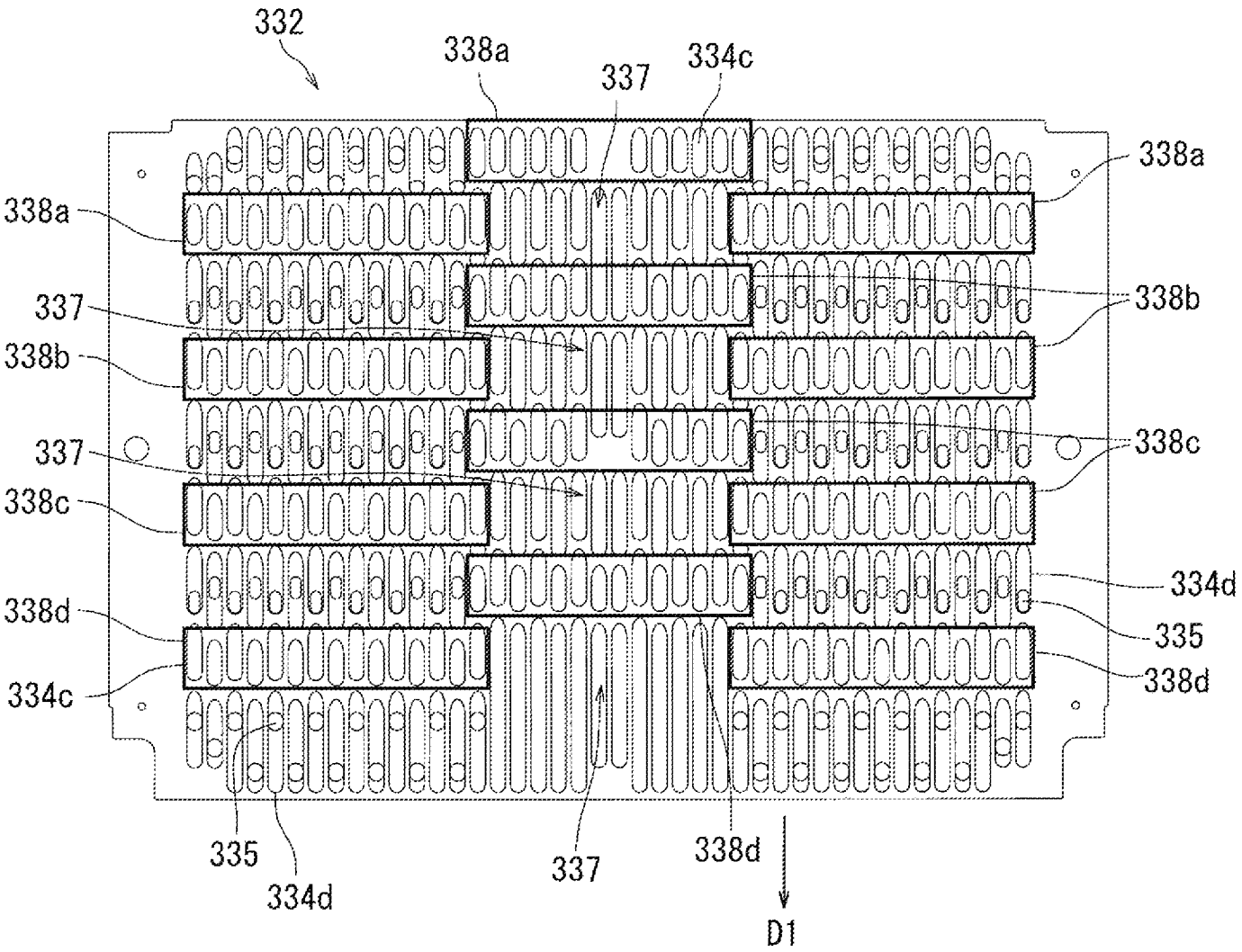
FIG. 13 is a plan view of a guide member according to the seventh variation of the embodiment.

FIG. 13 is a plan view of a guide member 332 according to the seventh variation of the embodiment.

As illustrated in FIG. 13, the third grooves 334*c* and the fourth grooves 334*d* lie in the guide member 332 in the seventh embodiment. The third grooves 334*c* lie in the head facing regions 338 and the partial region 337, while the fourth grooves 334*d* lie in the fourth region where the head non-facing region does not overlap with the partial region 337.

The above configuration can reduce the suction draft generated above the partial region 337 as well as above the head facing regions 338. Blowing up of the paper dust can be accordingly suppressed above the partial region 337 where especially much paper dust is conveyed. As a result, adhesion of the paper dust to the nozzles can be further effectively prevented.

According to the present embodiment, none of the through holes 335 are located in the first regions 339*a*. In addition, the through holes 335 may be located in the second regions apart as far as possible from the first regions 339*a*. Alternatively, neither the grooves 334 nor the through holes 335 may be formed in the first regions 339*a*. Further, the grooves 334 in which none of the through holes 335 are located may lie in the partial region 337. Alternatively, neither the grooves 334 nor the through holes 335 may be formed in the partial region 337. The partial region 337 may be conductive. Each or any combinations of the above features can reduce the suction draft generated above the first regions 339*a* in the head facing regions 338 where especially much paper dust is present. Thus, blowing up of the paper dust and adhesion thereof to the nozzles can be prevented above the first regions 339*a* where especially much paper dust is present. In turn, occurrence of nozzle clogging caused by adhesion of the paper dust can be reduced effectively.

Still further, the through holes 335 may be located in the third regions 339*c*. This can effectively secure the suction force acting on the paper P above the third regions 339*c*, thereby preventing lift off of the paper P. Prevention of lift off of the paper P in the third regions 339*c* can result in prevention of lift off of the paper P in the first regions 339*a* adjacent to the third regions 339*c*. Thus, an image artifact can be reduced that may be caused due to change in distance between the inkjet heads 340 and the paper P. Furthermore, occurrence of a paper jam immediately below the inkjet heads 340 can be reduced.

Alternatively, the through holes 335 may not be located in the head facing regions 338 and be located in the head non-facing region. This can suppress blowing up of the paper dust above the head facing regions 338, thereby preventing adhesion of the paper dust to the nozzles. At least one through hole 335 (a close-up through hole 335*a*) of the of through holes 335 is located in the head non-facing region closely to a head facing region 338. This can slightly increase the suction draft generated above the head facing regions 338, particularly a part around the close-up through hole 335*a*, thereby preventing lift off of the paper P. The close-up through hole 335*a* is located in a head non-facing region closely to a third region 339*c* where not so much paper dust is present. This configuration can effectively prevent adhesion of the paper dust to the nozzles and lift off of the paper P. As has been described so far, according to the present embodiment, adhesion of the paper dust to the nozzles and lift off of the paper P immediately below the inkjet heads 340 can be prevented with such a simple configuration.

Further, at least one third groove 334*c* (a groove 334 in which no through hole 335 is formed) may be located in a head facing region 338. This can suppress blowing up of the paper dust above the head facing region 338, thereby preventing adhesion of the paper dust to the nozzles.

Alternatively, the third grooves 334*c* in which none of the through holes 335 are formed may lie in the head facing regions 338 and the partial region 337, while the fourth grooves 334*d* in which the through holes 335 are formed may lie in the fourth region. Thus, blowing up of the paper dust can be suppressed, thereby enabling prevention of adhesion of the paper dust to the nozzles above the partial region 337 where especially much paper dust is conveyed.

Although one embodiment has been described so far, the present disclosure is not limited to the above embodiment. A variety of alterations can be made within the scope not departing from the subject matter of the present disclosure. It should be noted that the drawings schematically illustrate the respective elements for better understanding. The thickness, length, number, etc. of each of the illustrated elements are different from the practical ones for the sake of convenience in the drawings. Moreover, the materials, shapes, dimensions, etc. of the respective elements in the embodiment are only examples and should not be taken to limit the present embodiment.

For example, the through holes 335 have, but do not limited to have, a circular shape when viewed in plan in the present embodiment and may have a rectangular shape when viewed in plan. Also, the grooves 334 have, but do not limited to have, an oval shape when viewed in plan in the present embodiment and may have a rectangular shape when viewed in plan.

Furthermore, the inkjet recording device 1 is, but not limited to be, of line head type and may be of serial type.

Still further, the plural inkjet heads 340 for plural colors are, but not limited to be, arranged in a staggered manner in the width direction of the support surface 333. For example, the plural inkjet heads 340 for each color may be aligned in the width direction of the support surface 333. Alternatively, for example, a single inkjet head 340 for each color may be provided.

The inkjet recording device 1 in the present embodiment is, but not limited to be, capable of forming full-color images. The inkjet recording device may be an inkjet recording device that forms monochrome images. In other words, the image forming section 300 may include an inkjet head 340*a* for black color alone.

In addition, the recording medium in the present embodiment is, but is not limited to, paper and may be a resin sheet or cloth, for example.

Description has been made about the inkjet recording device 1 including the conveyor device 310 in the present embodiment. However, the conveyor device 310 may be built into another recording device, for example, an electrographic image forming apparatus.

What is claimed is:

1. A conveyor device arranged to face a recording head, comprising:

a conveyance belt configured to convey a recording medium; and a suction section including a guide member that supports the recording medium through the conveyance belt and configured to suck the recording medium through a plurality of first holes passing through the guide member and a plurality of second holes passing through the conveyance belt to attach the recording medium to the conveyance belt;

wherein none of the first holes are located in a first region of the guide member, the first region is a region where a partial region of the guide member pertaining to a feeding member overlaps with a head facing region of the guide member facing the recording head, and the feeding member is provided on a path through which the recording medium is conveyed to the conveyor device, and feeds the recording medium from an upstream side to a downstream side of the path.

2. A conveyor device according to claim 1, wherein the partial region is a region of the guide member that corresponds to a belt partial region of the conveyance belt, and the belt partial region is a region of the conveyance belt where a part of the recording medium that comes in contact with the feeding member is loaded.

3. A conveyor device according to claim 1, wherein the guide member has a plurality of grooves, and the first holes are located in bottoms of the grooves.

4. A conveyor device according to claim 3, wherein none of the groove lie in the first region.

5. A conveyor device according to claim 1, wherein the first region includes a plurality of first regions, a first hole of the first holes is located in a second region of the guide member where distances to two first regions of the plurality of first regions between which the second region is interposed are equal, and the second region is a region in the partial region that does not overlap with the head facing region.

6. A conveyor device according to claim 3, wherein none of the grooves lie in the partial region.

7. A conveyor device according to claim 3, wherein none of the first holes are located in bottoms of grooves in the partial region among the grooves in the guide member.

8. A conveyor device according to claim 1, wherein the first holes are located in a third region of the guide member, and the third region is a region in the head facing region that does not overlap with the partial region.

9. A conveyor device according to claim 8, wherein the first hole in the third region is located around an outer edge of the third region.

10. A conveyor device according to claim 1, wherein the first holes are not located in the head facing region and are located in a head non-facing region of the guide member that does not face the recording head, and at least one of the first holes is located in the head non-facing region closely to the head facing region.

11. A conveyor device according to claim 10, wherein the at least one first hole located closely to the head facing region is located closely to a third region of the guide member, and the third region is a region in the head facing region that does not overlap with the partial region.

12. A conveyor device according to claim 11, wherein in the third region, one or more first grooves extend from the third region to a region in the head non-facing region that does not overlap with the partial region, and the at least one first hole located closely to the head facing region is located in a bottom of each of the first grooves.

13. A conveyor device according to claim 10, wherein the guide member has a plurality of grooves, the first holes are located in bottoms of the grooves, and the grooves do not lie in the head facing region and lie in the head non-facing region.

14. A conveyor device according to claim 1, wherein at least one third groove in which none of the first holes are located and a plurality of fourth grooves in which the first holes are located lie in the guide member, and the at least one third groove lies in the head facing region.

15. A conveyor device according to claim 1, wherein a plurality of third grooves in which none of the first holes are located and a plurality of fourth grooves in which the first holes are located lie in the guide member, the third grooves lie in the head facing region and the partial region, and the fourth grooves lie in a region in a head non-facing region of the guide member that does not face the recording head and that does not overlap with the partial region.

16. A conveyor device according to claim 14, wherein the third grooves each have a surface made from a material having absorptivity.

17. A conveyor device according to claim 1, wherein the partial region is conductive.

18. An inkjet recording device comprising:

a conveyor device according to claim 1; and the recording head;

wherein the recording head includes an inkjet head that ejects ink droplets.

* * * * *